United States Patent [19]

Logan

[11] Patent Number: 4,746,382

[45] Date of Patent: May 24, 1988

[54] COMPOSITION TO IMPROVE ADHESIVENESS OF PREPASTED WALLPAPER AND METHOD OF USE

[75] Inventor: William H. Logan, Montreal, Canada

[73] Assignee: Swing Paints, Ltd., Montreal, Canada

[21] Appl. No.: 903,965

[22] Filed: Sep. 5, 1986

[51] Int. Cl.[4] ..... E04B 2/00

[52] U.S. Cl. ..... 156/71; 52/746; 106/287.24; 106/287.29; 106/287.32; 156/308.6; 156/308.8; 156/324.4; 252/352; 427/207.1; 427/336; 427/337; 428/350

[58] Field of Search ..... 156/71, 308.6, 324.4, 156/308.8; 52/746; 428/350; 427/336, 337, 207.1; 106/287.29, 287.32, 287.24; 252/352

[56] References Cited

U.S. PATENT DOCUMENTS

| | | | |
|---|---|---|---|
| 2,291,800 | 8/1942 | Drake . | |
| 2,347,865 | 4/1943 | Yates et al. . | |
| 2,567,159 | 9/1951 | Vitalis | 252/352 |
| 2,887,504 | 5/1959 | Carnes et al. . | |
| 2,969,332 | 1/1961 | Lawler et al. . | |
| 3,463,735 | 8/1969 | Stonebraker et al. | 252/171 |
| 3,969,043 | 10/1972 | Labarge et al. . | |
| 3,975,294 | 8/1976 | Dumoulin | 106/287.32 |
| 4,328,279 | 5/1982 | Meitner et al. . | |
| 4,355,073 | 10/1982 | Knightley . | |
| 4,434,090 | 2/1984 | Hampson et al. . | |

*Primary Examiner*—John J. Gallagher

*Attorney, Agent, or Firm*—Foley & Lardner, Schwartz, Jeffery, Schwaab, Mack, Blumenthal & Evans

[57] ABSTRACT

For preparing pre-pasted wallpaper for hanging against a flat surface, the pre-pasted wallpaper is contacted with warm water which contains a composition including a wetting agent such as a dialkyl ester sulfosuccinic acid derivative, with possibly an agent enabling the wetting agent to dissolve in water and also a water softening agent. The net result is an improved adhesiveness over standard contact with warm water alone.

17 Claims, No Drawings

COMPOSITION TO IMPROVE ADHESIVENESS OF PREPASTED WALLPAPER AND METHOD OF USE

BACKGROUND OF THE INVENTION

1. Field of the Invention

This invention relates to a composition to improve the adhesiveness of pre-pasted wallpaper. More particularly, the present invention is directed to a composition capable to provide improved adhesiveness to pre-pasted wallpaper once the latter has been contacted with warm water prior to hanging on a flat surface, such as a wall or a ceiling. The invention also relates to an improved method of preparing wallpaper for hanging against a flat surface wherein the pre-pasted wallpaper is contacted with warm water containing a wetting agent.

2. Description of the Prior Art

For a long time, the preparation of a length of wall paper for hanging was simply carried out by spreading a coat of wallpaper glue on the back of the wallpaper. A few decades ago, a new technology was developed which involved the coating of wallpaper with a thin layer of glue, that operation being carried out at the mill. The product is now commonly known as pre-pasted wallpaper and is widely used. To prepare pre-pasted wallpaper for hanging it is merely sufficient to contact it with warm water which will turn the coating on the wallpaper into an adhesive. This is usually carried out by using a small elongated container filled with warm water. It is merely sufficient to previously roll the length of paper to be hung and to thereafter unroll it by passing it through the water present in the container. The speed at which the pre-pasted paper is passed through the warm water and the temperature of the latter are both quite critical with the result that for the normal handyman, it is nearly impossible to achieve good adhesiveness so that some people prefer not to use such type of wallpaper. There is therefore a need to enable the pre-pasted wallpaper to achieve good adhesiveness after having been contacted with warm water, without complicating the operation as a whole.

The general technique involved in hanging pre-pasted wallpaper is disclosed in U.S. Pat. No. 2,347,865. On the other hand, a discussion of the type of adhesives used in pre-pasted wallpaper as well as a new type of adhesive are discussed in U.S. Pat. No. 4,355,073. Finally, a treatment of a wall surface to improve the adhesiveness of wallpaper is disclosed in U.S. Pat. No. 2,291,800.

U.S. Pat. No. 3,696,043 describes the combination of a dialkyl ester of sulfosuccinic acid with water and alcohol. These dialkyl esters are also disclosed in the following U.S. Pat. Nos.:

2,887,504
2,969,332
4,328,279
4,434,090

It is not believed however, that a composition or a method have been disclosed to achieve an improved adhesiveness of pre-pasted wallpaper.

It is therefore an object of the present invention to provide a composition capable of improving the adhesiveness of pre-pasted wallpaper once the latter has been contacted with warm water.

It is another object of the present invention to provide a composition which will improve the adhesiveness of pre-pasted wallpaper.

SUMMARY OF THE INVENTION

In accordance with the present invention, there is provided a method of preparing pre-pasted wallpaper for hanging against a flat surface wherein the pre-pasted wallpaper is contacted with warm water. The method comprises adding to the warm water a composition comprising a wetting agent capable of improving the adhesiveness of the pre-pasted wallpaper without causing any bleeding thereof.

In accordance with the invention, there is also provided a composition capable of providing improved adhesiveness to pre-pasted wallpaper once the latter has been contacted with warm water, the composition comprising a wetting agent, an agent enabling the wetting agent to dissolve in water, and a water softening agent.

DESCRIPTION OF PREFERRED EMBODIMENTS

The composition according to the invention preferably is conditioned as an aqueous solution of the wetting agent, the agent enabling the wetting agent to dissolve in water and the water softening agent.

In accordance with a preferred embodiment of the invention, the wetting agent comprises a dialkyl ester sulfonic acid derivative such as sodium dioctyl sulfosuccinate, sodium dihexyl sulfosuccinate, sodium diamyl sulfosuccinate or disodium N-octadecyl sulfusuccinamate.

The preferred agent enabling the wetting agent to dissolve in water comprises an alcohol, a glycol, a ketone, or the like, such as isopropyl alcohol, acetone, amyl alcohol, 2-butanol, ethyl alcohol, butyl carbitol TM, butyl cellosolve TM, diacetone alcohol, diethylene glycol, ethyl lactate, furfuryl alcohol, methanol, methyl acetate, synosol TM solvent, tetrahydro furfuryl alcohol, and the like. In practice, this agent is isopropyl alcohol or diethylene glycol.

Any water softener could be used in practicing the present invention, the preferred water softener being chosen among alkali or alkaline earth metal derivatives of phosphoric acid, such as sodium hexametaphosphate.

For example, the composition according to the invention may include an alkali or alkali earth metal derivative of phosphoric acid, a dialkyl ester sulfosuccinic acid derivative, an alcohol or a glycol, and water in an amount sufficient to constitute an aqueous solution of the above ingredients.

A preferred composition comprises between about 0.01 and about 5.0 weight percent of the alkali or alkali earth metal derivative of phosphoric acid, between about 5.0 and about 25.0 weight percent of the dialkyl ester sulfosuccinic acid derivative, between about 10.0 and about 20.0 weight percent of the alcohol or glycol, and the balance is water.

Typically, the composition comprises about 0.5 weight percent sodium hexametaphosphate, about 11.0 weight percent monosodium dioctyl sulfosuccinate, about 11.0 weight percent isopropanol, and the balance is water.

According to a preferred embodiment of the invention, sodium chloride may also be included in the composition at a rate of for example up to about 1.0 weight percent.

In accordance with a preferred embodiment of the invention at least about 60 cc of the composition according to the invention, for example between about 60 cc and about 120 cc, are added to about four litres of warm water.

EXAMPLE

A composition was prepared on the basis of the following ingredients:

Sodium hexametaphosphate: 0.5 wt %
Monosodium dioctyl sulfusiccinate: 10.8 wt %
Isopropanol: 17.1 wt %
Water: 71.6 wt %

This composition was added at a rate of 60 cc to one gallon of warm water present in a wallpaper hanging container. The adhesiveness of the wallpaper thus treated is substantially improved over that obtained by the standard method.

The amounts of ingredients in the composition and the nature of the various agents can vary to a large extent as is well known to those skilled in the art. For example, more than about 25 weight percent of wetting agent may induce bleeding, i.e. discoloration or fading, of the wallpaper.

Although the agent such as the isopropanol enabling the wetting agent to dissolve is not absolutely necessary, it has been found, that in addition, this agent will improve the adhesiveness of the wallpaper treated by the method according to the invention.

The same comment applies to the water softener. It has however been found that for several applications of the composition according to the invention, the water softener should preferably be present.

Finally, sodium chloride,or other electrolytes seem to give a still improved adhesiveness and wetting when used in conjunction with the formulation.

The effect of the addition of the wetting agent is to reduce the surface tension of water from 72.3 to 27.3–28.5 and lower.

I claim:

1. In a method of preparing pre-pasted wallpaper for hanging against a flat surface wherein said pre-pasted wallpaper is contacted with warm water, the improvement which comprises adding to said warm water a composition comprising a wetting agent capable of improving the adhesiveness of said pre-pasted wallpaper without causing any bleeding thereof.

2. A method according to claim 1, wherein said composition comprises said wetting agent, an agent enabling said wetting agent to dissolve in water, and a water softening agent.

3. A method according to claim 2, wherein said composition is conditioned as an aqueous solution of said wetting agent, said agent enabling said wetting agent to dissolve in water and said water softening agent.

4. A method according to claim 3, wherein said wetting agent comprises a dialkyl ester sulfosuccinic acid derivative.

5. A method according to claim 4, wherein said wetting agent is selected from the group consisting of sodium dioctyl sulfosuccinate, sodium dihexyl sulfosuccinate, sodium diamyl sulfosuccinate, and disodium N-octadecyl sulfosuccinamate.

6. A method according to claim 3, wherein said agent enabling said wetting agent to dissolve in water comprises an alcohol.

7. A method according to claim 4, wherein said agent enabling said wetting agent to dissolve in water is selected from the group consisting of isopropyl alcohol, acetone, amyl alcohol, 2-butanol, ethyl alcohol, butyl carbitol TM, butyl cellosolve TM, diacetone alcohol, diethylene glycol, ethyl lactate, furfuryl alcohol, methanol, methyl acetate, synosol TM solvent, and tetrahydro furfuryl alcohol.

8. A method according to claim 2, wherein said agent enabling said wetting agent to dissolve in water comprises isopropyl alcohol.

9. A method according to claim 2, wherein said agent enabling said wetting agent to dissolve in water comprises diethylene glycol.

10. A method according to claim 3, wherein said water softening agent comprises an alkali or alkaline earth metal derivative of phosphoric acid.

11. A method according to claim 2, wherein said water softening agent comprises sodium hexametaphosphate.

12. A method according to claim 1, wherein said composition comprises (a) an alkali or alkaline earth metal derivative of phosphoric acid, (b) a dialkyl ester sulfosuccinic acid derivative, (c) an alcohol or a glycol, and (d) water in an amount sufficient to constitute an aqueous solution of (a), (b) and (c).

13. A method according to claim 12, wherein said composition comprises between about 0.01 and about 5.0 weight percent of said alkali or alkaline earth metal derivative of phosphoric acid, between about 5.0 and about 25.0 weight percent of said dialkyl ester of sulfosuccinic acid derivative, between about 10.0 and about 20.0 weight percent of said alcohol or glycol, and the balance comprising water.

14. A method according to claim 12, wherein said composition comprises about 0.5 weight percent sodium hexametaphosphate, about 11.0 weight percent monosodium dioctyl sulfosuccinate, about 11.0 weight percent isopropanol, and the balance comprising water.

15. A method according to claim 14, wherein said composition also comprises up to about 1.0 weight percent of sodium chloride.

16. A method according to claim 13 which comprises adding at least about 60 cc of said composition to one gallon of said warm water.

17. A method according to claim 13 which comprises adding between about 60 cc and about 120 cc of said composition to one gallon of said warm water.

* * * * *